US009279204B2

(12) United States Patent
Tomizawa et al.

(10) Patent No.: US 9,279,204 B2
(45) Date of Patent: Mar. 8, 2016

(54) EMBROIDERY CLOTH PRESSER

(71) Applicant: JANOME SEWING MACHINE Co., Ltd., Tokyo (JP)

(72) Inventors: Shigeru Tomizawa, Tokyo (JP); Eiichi Shomura, Tokyo (JP); Yukio Hosaka, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 0 days.

(21) Appl. No.: 14/161,762

(22) Filed: Jan. 23, 2014

(65) Prior Publication Data

US 2014/0216316 A1 Aug. 7, 2014

(30) Foreign Application Priority Data

Feb. 1, 2013 (JP) ..... 2013-18221

(51) Int. Cl.

| | |
|---|---|
| ***D05B 29/06*** | (2006.01) |
| ***D05B 29/12*** | (2006.01) |
| ***D05C 9/02*** | (2006.01) |
| ***D05C 11/00*** | (2006.01) |

(52) U.S. Cl.

CPC ..... *D05B 29/12* (2013.01); *D05B 29/06* (2013.01); *D05C 9/02* (2013.01); *D05C 11/00* (2013.01)

(58) Field of Classification Search

CPC ..... D05B 29/10; D05B 29/06; D05B 29/12
USPC ..... 112/235, 236
See application file for complete search history.

(56) References Cited

U.S. PATENT DOCUMENTS

| | | | | | |
|---|---|---|---|---|---|
| 47,978 | A | * | 5/1865 | Peterson | 112/153 |
| 106,228 | A | * | 8/1870 | Stocker | 112/324 |
| 202,303 | A | * | 4/1878 | Trowbridge | 112/152 |
| 262,270 | A | * | 8/1882 | Bayley | 112/235 |
| 282,113 | A | * | 7/1883 | Parkhill | 112/235 |
| 338,163 | A | * | 3/1886 | Conpropst | 112/235 |
| 381,090 | A | * | 4/1888 | Sutherland | 112/235 |
| 494,224 | A | * | 3/1893 | Philbrick | 112/235 |

(Continued)

FOREIGN PATENT DOCUMENTS

| | | |
|---|---|---|
| DE | 2165 615 A1 | 7/1972 |
| DE | 10 2008 051 945 A1 | 5/2009 |

(Continued)

OTHER PUBLICATIONS

European Search Report dated May 19, 2014.

*Primary Examiner* — Danny Worrell
(74) *Attorney, Agent, or Firm* — McGinn IP Law Group PLLC

(57) ABSTRACT

An object of the present invention is to provide an embroidery cloth presser which prevents a needle thread from being sandwiched between the embroidery cloth presser and a cloth to allow an embroidery frame to move smoothly and which also prevents inappropriate draw-in of the needle thread, that is, prevents a cross-over thread of the needle thread resulting from long-distance movement of the embroidery frame from remaining on an embroidery surface. An embroidery cloth presser is installed on a presser bar of a sewing machine to press a cloth to be embroidered and which includes a projection provided on a bottom surface of the cloth presser which contacts the cloth around a needle and forming, between the cloth presser and the cloth, a gap through which a needle thread passes.

15 Claims, 6 Drawing Sheets

(56) References Cited

U.S. PATENT DOCUMENTS

| | | | | | |
|---|---|---|---|---|---|
| 659,317 | A | * | 10/1900 | Peterson | 112/235 |
| 843,440 | A | * | 2/1907 | Burrage | 112/134 |
| 948,683 | A | * | 2/1910 | Elllis | 112/236 |
| 954,990 | A | * | 4/1910 | Noble | 112/235 |
| 1,147,960 | A | * | 7/1915 | Mathewson | 112/235 |
| 1,501,901 | A | * | 7/1924 | Gatchell | 112/235 |
| 1,630,754 | A | * | 5/1927 | McNulty | 112/136 |
| 3,026,837 | A | * | 3/1962 | Enos | 112/236 |
| 4,480,566 | A | * | 11/1984 | Lukawich et al. | 112/321 |
| 4,513,675 | A | * | 4/1985 | Meyer et al. | 112/236 |
| 4,554,878 | A | * | 11/1985 | Laidig | 112/235 |
| 5,317,981 | A | * | 6/1994 | Hashiride et al. | 112/470.04 |
| 6,748,889 | B2 | * | 6/2004 | Martelli et al. | 112/235 |

FOREIGN PATENT DOCUMENTS

| | | | |
|---|---|---|---|
| EP | 1 707 659 | A1 | 10/2006 |
| GB | 13930 | | 10/1913 |
| GB | 1011371 | | 11/1965 |
| JP | 2005-058360 | A | 3/2005 |

* cited by examiner

IMPORTANT PART E

IMPORTANT PART F

EMBROIDERY CLOTH PRESSER

BACKGROUND OF THE INVENTION

1. Field of the Invention

The present invention relates to a embroidery cloth presser installed on a presser bar of a sewing machine, and more particularly to an embroidery cloth presser suitable for a sewing machine with a cloth presser mechanism that maintains a predetermined presser height, depending on the thickness of a cloth without moving up or down in synchronization with up-and-down motion of a needle.

2. Description of the Related Art

In conventional embroidery sewing machines, a cloth presser mechanism that presses a cloth to be embroidered moves up and down at a timing synchronized with up-and-down motion of a needle to move an embroidery frame while a cloth presser is elevating from a cloth surface (see, for example, Japanese Patent Application Laid-open No. 2005-58360).

With the cloth presser mechanism thus operated, the cloth presser lowers onto the cloth surface to hold the cloth while the needle is being inserted into the cloth and elevates when the needle separates from the cloth, allowing the cloth to be smoothly moved.

On the other hand, in recent years, a sewing machine has been proposed which automatically adjusts the presser foot height of the cloth presser. Thus, unlike a conventional cloth pressing mechanism of moving a cloth presser up and down, for embroidering purposes, sewing machines have also been proposed which have a cloth presser mechanism for lowering the cloth presser onto the cloth surface depending on the thickness of the cloth to be embroidered and maintaining the presser height constant so as to exert an appropriate pressure sufficient to avoid hindering movement of the cloth.

However, a bottom surface of the conventional embroidery cloth presser is compressed against the cloth so that the bottom surface and the cloth are flush with each other as in the case of a presser foot member 4 described in Japanese Patent Application Laid-open No. 2005-58360, and thus, a needle thread is sandwiched between the bottom surface of the embroidery cloth presser and the cloth. This may hinder movement of the embroidery frame.

Furthermore, FIG. 6 shows the state of an embroidery cloth presser 1*a* and a needle thread Ta in which, when the embroidery frame moves a long distance in order to move from a currently sewn block of a pattern to the next block of the pattern to be sewn, a seam of a link formed by the needle thread Ta on a cloth Ca so as to tie both pattern blocks together, that is, a cross-over thread, is cut by an automatic thread cutter (not shown in the drawings) and sewing is then started. However, as shown in FIG. 6, the cross-over thread of the needle thread Ta is sandwiched between a bottom surface 14*a* of the embroidery cloth presser 1*a* and the cloth Ca. Thus, disadvantageously, the needle thread Ta, otherwise drawn into an underside of the cloth Ca when a needle 2*a* is inserted into the cloth Ca, remains on the embroidery surface without being drawn into the underside of the cloth Ca.

An object of the present invention is to solve the above-described problem and to provide an embroidery cloth presser which prevents the needle thread from being sandwiched between the embroidery cloth presser and the cloth to allow the embroidery frame to move smoothly and which also prevents the inappropriate draw-in of the needle thread, that is, prevents the cross-over thread of the needle thread resulting from long-distance movement of the embroidery frame from remaining on the embroidery surface.

SUMMARY OF THE INVENTION

To achieve this object, an aspect of the present invention adopts, as an embroidery cloth presser, a configuration of a cloth presser installed on a presser bar of a sewing machine to press a cloth to be embroidered, the cloth presser including a projection provided on a bottom surface of the cloth presser which contacts the cloth around a needle and forming, between the cloth presser and the cloth, a gap through which a needle thread passes.

The present invention adopts, as embodiments of the embroidery cloth presser, a configuration wherein at least two projections are provided, a configuration wherein the projections are arranged at predetermined intervals, a configuration wherein the projection has a semispherical surface shape at a tip thereof, and a configuration wherein the projection has a round truncated core shape or a truncated pyramid shape at a tip thereof.

The plurality of projections arranged at the predetermined intervals is provided on the bottom surface of the embroidery cloth presser for the sewing machine. Consequently, the needle thread passes between the projections while the tips of the projections are pressing and holding the cloth, thus preventing the needle thread from being sandwiched between the bottom surface of the embroidery cloth presser and the cloth. This allows the embroidery frame to move smoothly and also prevents a cross-over thread of the needle thread resulting from long-distance movement of the embroidery frame from remaining on the embroidery surface as a result of inappropriate draw-in of the cross-over thread after cutting of the cross-over thread.

BRIEF DESCRIPTION OF THE DRAWINGS

FIG. 2 is a diagram showing the embroidery cloth presser according to the embodiment of the present invention, wherein

FIG. 3 is a diagram showing the embroidery cloth presser according to the embodiment of the present invention, wherein

FIG. 5 is a diagram showing a state of embroidery sewing using the embroidery cloth presser according to the embodiment of the present invention, wherein FIG. 6 is a diagram showing a state of embroidery sewing using an embroidery cloth presser according to a conventional technique, wherein

DESCRIPTION OF THE PREFERRED EMBODIMENTS

Now, an embroidery cloth presser according to the present invention will be described with reference to the drawings showing embodiments.

Embodiment 1

Figure 1:
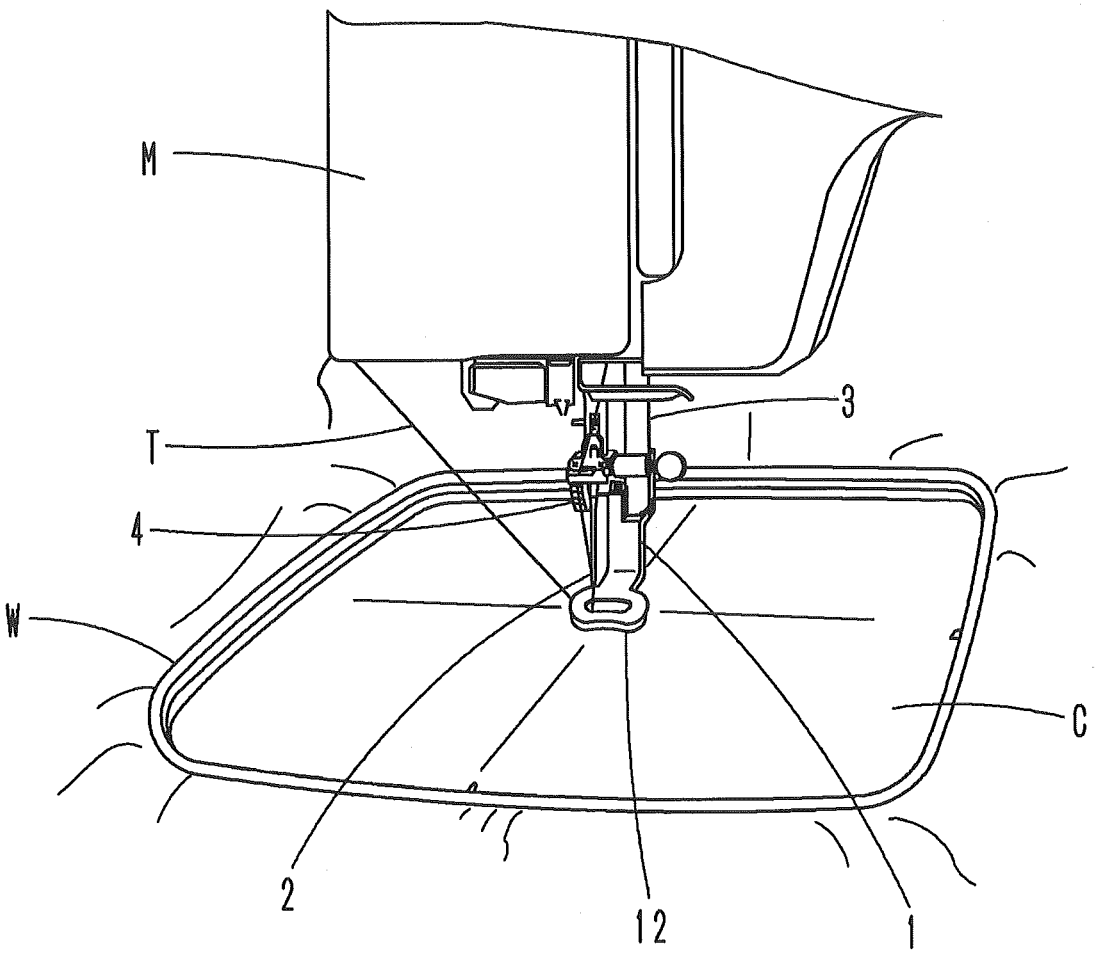
FIG. 1 is a perspective view showing an embroidery sewing state of a sewing machine with an embroidery cloth presser installed thereon according to an embodiment of the present invention.

In FIG. 1, a sewing machine is denoted by M. A cloth is denoted by C. A needle thread is denoted by T. An embroidery frame is denoted by W.

As shown in FIG. 1, the cloth C is held by the embroidery frame W and can be moved along with the embroidery frame W in an X-Y direction perpendicular to up-and-down motion direction of a needle 2, by means of an embroidery frame moving device (not shown in the drawings) provided in the sewing machine M.

An embroidery cloth presser 1 is attached with a set screw 4 to a lower end of a presser bar 3 supported behind the needle 2 by the sewing machine M.

Figure 2A:
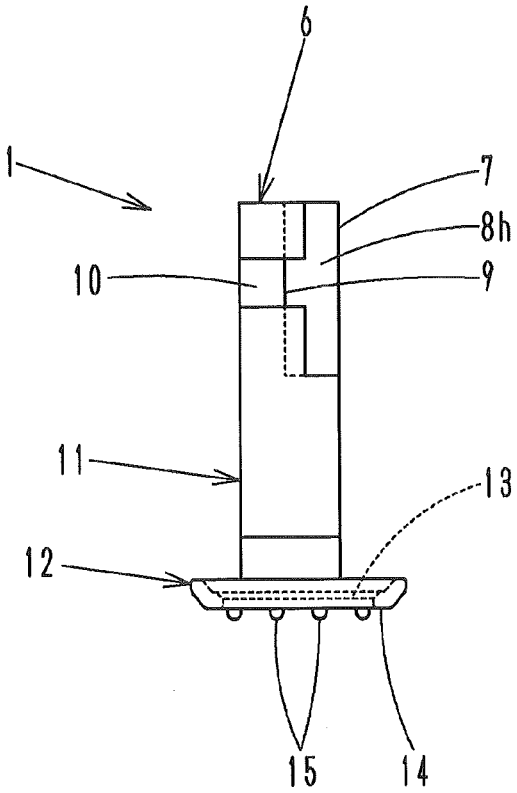
FIG. 2A is a front view and FIG. 2B is a side view.
Figure 2B:
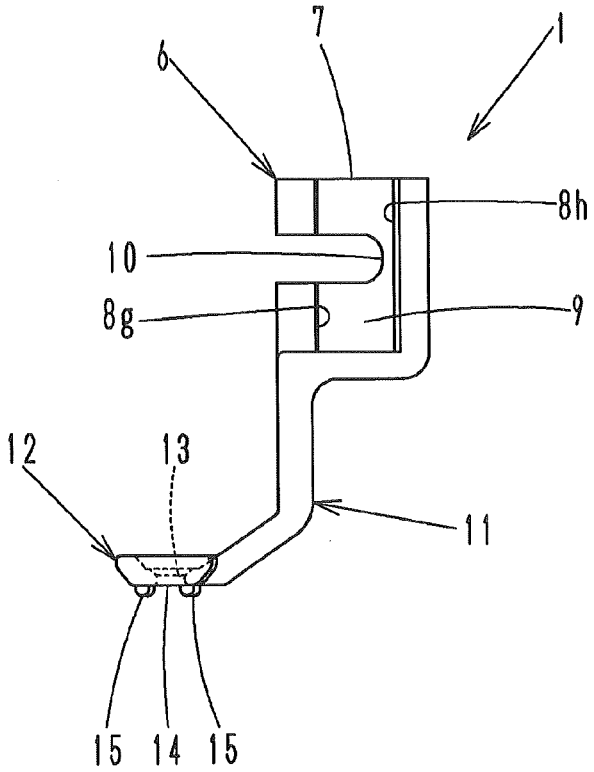

As shown in FIG. 2 and FIG. 3, an upper portion of the embroidery cloth presser 1 serves as an attachment portion 6 attached to the presser bar 3 and includes a recessed portion 7 through which a lower end of the presser bar 3 is fitted and a screwing groove 10 in which the set screw 4 threaded into a threaded hole 5 in the presser bar 3 is fitted.

The recessed portion 7 appears to be generally U-shaped in planar view and includes an attachment surface 9 that comes into abutting contact with a side surface of the presser bar 3 to form a stable fixed state when the set screw 4 is tightened, and fitting surfaces 8*g* and 8*h* extending laterally from the attachment surface 9 to form an opening opposite the attachment surface 9.

At least one of the fitting surfaces 8*g* and 8*h* is slightly inclined so that the presser bar 3 can be laterally fitted easily through the recessed portion.

According to Embodiment 1, the fitting surface 8*h*, which is located on the other side of a presser portion 12 to face the other fitting surface 8*g*, i.e., the fitting surface 8*h* being on the back side, is slightly inclined and extends longer than the fitting surface 8*g* in the lateral direction. Moreover, the fitting surface 8*h* forms a guide surface that allows the presser bar 3 to be fitted through the recessed portion.

The screwing groove 10 is formed by laterally cutting the attachment portion 6 out, and extends from the front fitting surface 8*g* to a position on the attachment surface 9 which corresponds to the threaded hole 5.

Embodiment 1 provides an attachment structure in which the attachment surface 9 of the attachment portion 6 and a surface of the presser bar 3 corresponding to the attachment surface 9 are planes that come into tight contact with each other and in which the attachment portion 6 can be easily attached to the presser bar 3 by laterally fitting the embroidery cloth presser 1 over the presser bar 3. However, the present invention is not limited to such an attachment structure and other attachment structures may be employed.

A leg portion 11 extends obliquely forward from the bottom of the attachment portion 6 of the embroidery cloth presser 1, and a presser portion 12 is provided at a lower end of the embroidery cloth presser 1.

Figure 3A:
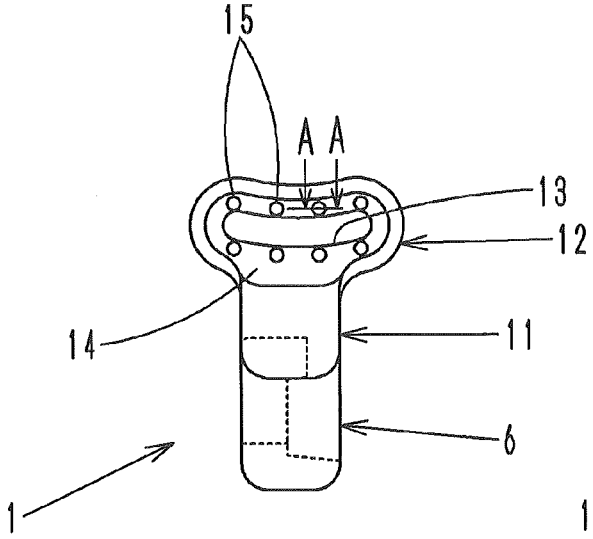
FIG. 3A is a bottom view.
Figure 3B:
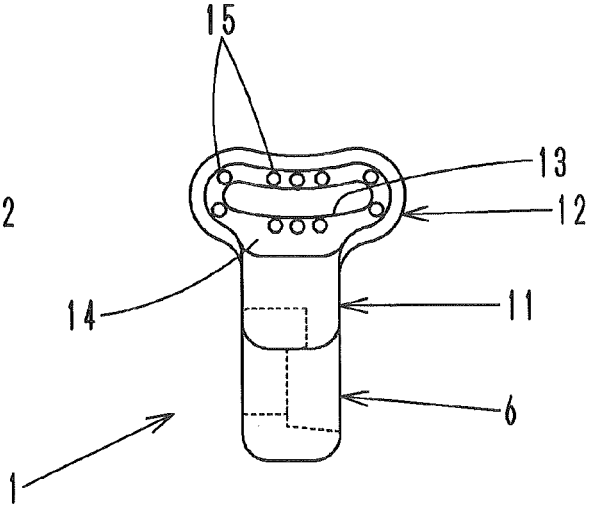
FIG. 3B is a bottom view of a modified embodiment.

As shown in FIG. 3A, the presser portion 12 includes an eye of the needle 13 shaped like a slightly curved slot and through which the needle 2 is inserted. The presser portion 12 includes a plurality of projections 15 arranged on a bottom surface 14 thereof at predetermined intervals so as to surround the eye of the needle 13.

According to Embodiment 1, the plurality of projections 15 is arranged at approximately regular intervals. However, the present invention is not limited to such an embodiment. The arrangement of the plurality of projections can be appropriately determined. For example, the projections may be arranged at irregular intervals as is the case with a variation shown in FIG. 3B.

Figure 3C:
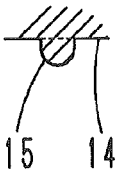
FIG. 3C is a cross-sectional view taken along line A-A in FIG. 3A.

As shown in FIG. 3C, the shape of the projection 15 is such that the projection has a height that prevents the needle thread from being sandwiched between the embroidery cloth presser and the cloth and that a tip of the projection is shaped like a semispherical surface to allow the needle thread to escape easily, while allowing the cloth to move smoothly.

The shape of the projection 15 is not limited to the shape according to Embodiment 1. The shape of the projection 15 can be varied to the extent that the needle thread can escape easily and that smooth movement of the cloth is implemented, by forming, for example, a truncated cone shape or a truncated pyramid shape in a peripheral corner portion of a tip plane, which is relatively significantly rounded, as provided in another modified embodiment in FIG. 3D.

Furthermore, the number and density of the arranged projections 15 may be appropriately determined in terms of a function to press and hold the cloth and a function to secure a gap through which the needle thread escapes. In some cases, a single projection may be formed provided that the cloth can be pressed with a gap formed between the embroidery cloth presser and the cloth so that the needle thread can pass through the gap.

Now, the use aspect and effects of Embodiment 1 will be described.

Figure 4:
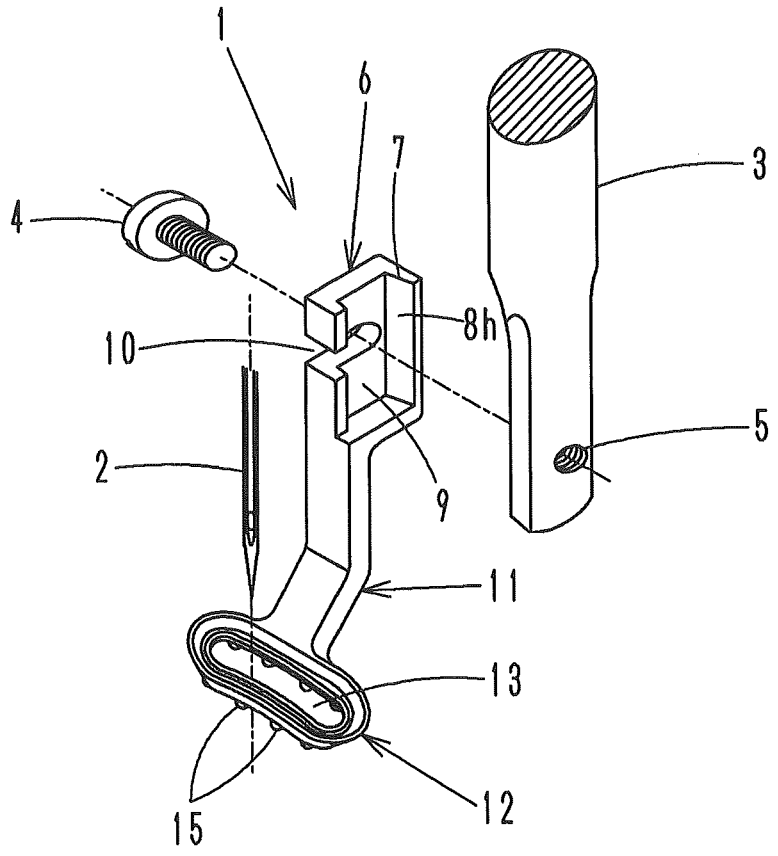
FIG. 4 is a perspective view of an assembly state in which the embroidery cloth presser is installed on a presser bar according to the embodiment of the present invention.

First, the embroidery cloth presser 1 according to Embodiment 1 is installed on the presser bar 3. As shown in FIG. 4, the presser bar 3 is fitted through the recessed portion 7. The set screw 4 is threaded through the screwing groove 10 from a rear side of the attachment surface 9 into the threaded hole 5 in the presser bar 3.

At this time, the rear fitting surface 8*h* is pressed along the presser bar 3 while the presser bar 3 is being fitted through the recessed portion 7. This prevents the embroidery cloth presser 1 from colliding against the needle 2, located in front of the embroidery cloth presser 1.

Furthermore, the screwing groove 10 is formed to extend from the front fitting surface 8*g* to a screw insertion position on the attachment surface 9. Thus, even in a place where the screw insertion position is located behind the needle 2 and is difficult to see, the set screw 4 can be easily fitted through the screwing groove 10. Moreover, the embroidery cloth presser 1 can be easily installed and removed by sliding the embroidery cloth presser 1 along the screwing groove 10 without the need to remove the set screw 4.

Then, when the set screw 4 is threaded into the threaded hole 5 and tightened, the attachment surface 9 and the corresponding surface of the presser bar 3 come into tight contact so as to be flush with each other, and the presser bar 3 is regulated in a front-back direction by the fitting surfaces 8*g* and 8*h*. Thus, the embroidery cloth presser 1 is stably fixed to the presser bar 3 so as not to rotationally moved or displaced.

The cloth C to be embroidered is held by the embroidery frame W and movably installed in the embroidery frame moving device (not shown in the drawings) of the sewing machine M.

The needle 2 through which the needle thread T has been inserted moves up and down to allow a bobbin thread and the needle thread T, both guided to, for example, a rotating hook or a looper (not shown in the drawings) located at a lower portion of the sewing machine M, to forma seam on a surface of the cloth C. Furthermore, the embroidery frame moving device is driven in the X-Y direction based on, for example, embroidery data to move the cloth C held by the embroidery frame W, thus producing various embroidery patterns.

These arrangements are similar to the corresponding arrangements of normal sewing machines and will not be described in detail.

Figure 5A:
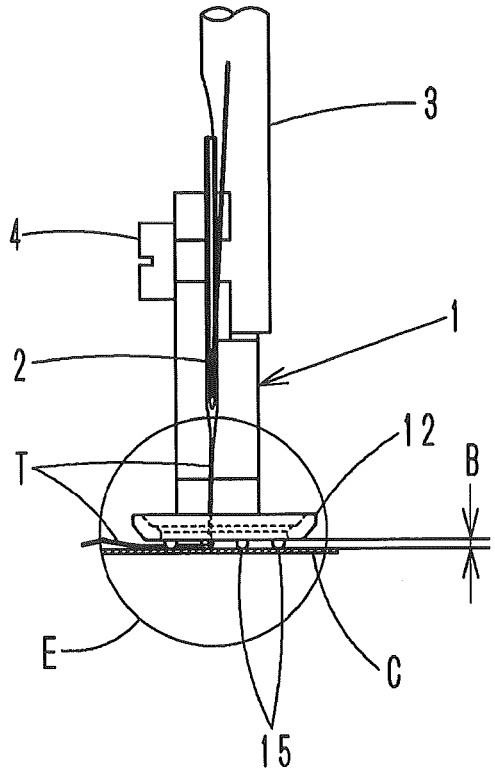
FIG. 5A is a front view and FIG. 5B is an enlarged view of a primary part in FIG. 5A.
Figure 5B:
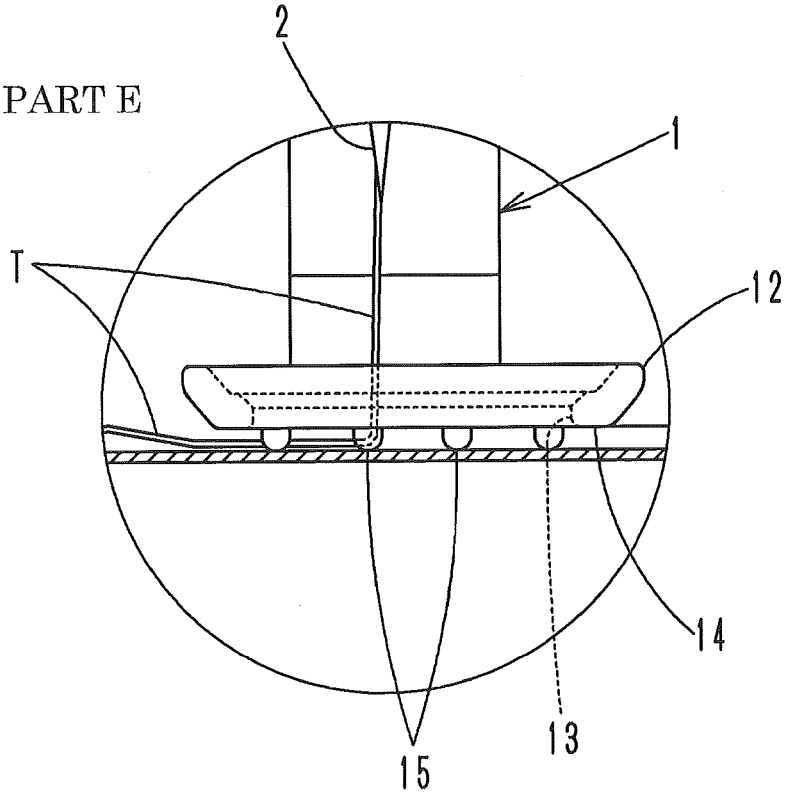
Figure 6A:
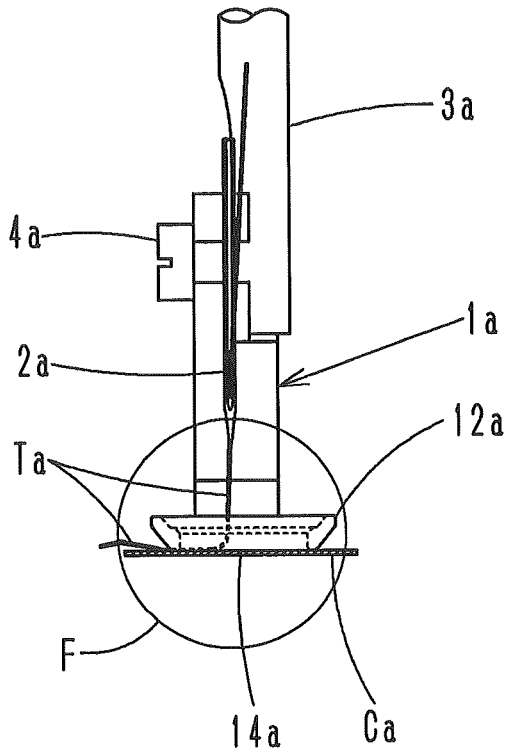
FIG. 6A is a front view and FIG. 6B is an enlarged view of a primary part in FIG. 6A.
Figure 6B:
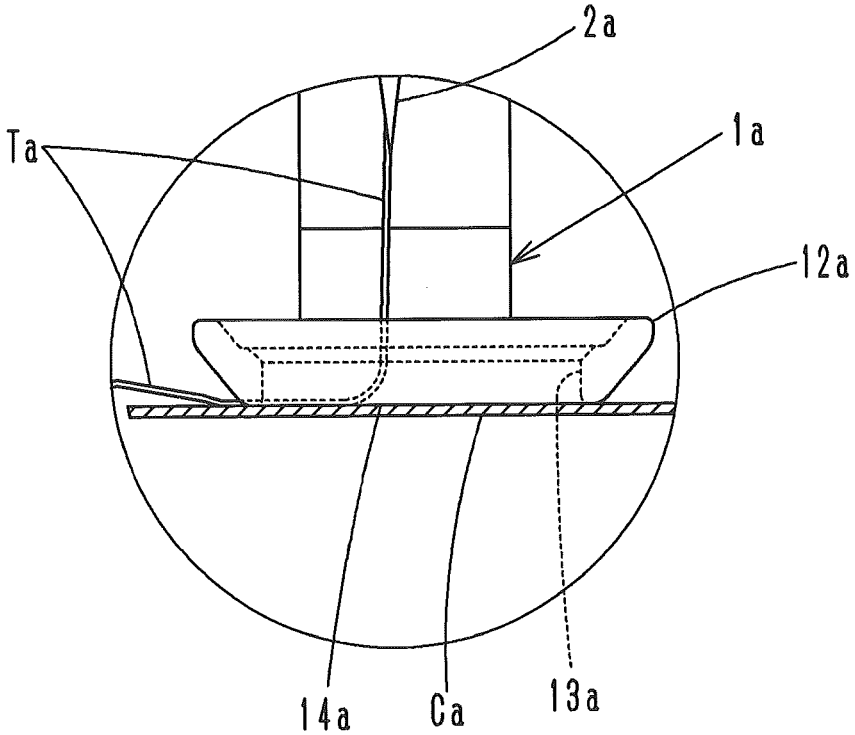

As shown in FIG. 5, when the embroidery frame W moves a long distance to generate a cross-over thread of the needle thread Ta on the cloth Ca, the cross-over thread traverses the area between the bottom surface 14 of the embroidery cloth presser 1 and the cloth C. However, since the plurality of projections 15 is arranged at the predetermined intervals on the bottom surface 14, which surrounds the eye of the needle 13, of the embroidery cloth presser 1, the tips of the plurality of projections 15 press the cloth C, whereas a distance B, which corresponds to height of the projection 15, is formed between the cloth C and parts of the bottom surface 14 where there is no projection.

Consequently, the cross-over thread of the needle thread T is drawn in, during formation of a seam, through the gaps between the plurality of projections 15 without being sandwiched between the bottom surface 14 and the cloth C, and is thus prevented from remaining on the cloth C.

At this time, the distance B between the bottom surface 14 and the cloth C, that is, the height of the projection 15, is desirably set equal to or larger than the diameter of the needle thread T. However, even when the height is slightly smaller than the diameter of the needle thread T, no problem occurs provided that the height is sufficient to allow the needle thread T to escape.

According to Embodiment 1, the tip of the projection 15 is shaped like a semispherical surface, allowing the needle thread T to escape easily and enabling the cloth to move smoothly.

Figure 3D:
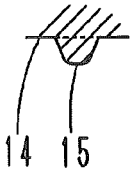
FIG. 3D is a cross-sectional view similar to FIG. 3C and which is taken along line A-A in FIG. 3A.

Furthermore, the shape of the projection 15 can be varied to the extent that the needle thread can escape easily and that smooth movement of the cloth is prevented from being hindered. When the projection 15 is shaped like a round truncated cone or truncated pyramid at the tip thereof as shown in FIG. 3D, the function to press the cloth can be enhanced.

Even when the embroidery cloth presser 1 according to Embodiment 1 is used for a sewing machine with a cloth presser mechanism that always lowers the cloth presser onto the upper surface of the cloth to maintain the presser height constant, smooth movement of the embroidery frame W is prevented from being hindered because the needle thread T is prevented from being sandwiched between the embroidery cloth presser 1 and the cloth C.

In particular, when the embroidery frame W is moved so as to move the position of a seam of an embroidery a long distance, a cross-over thread of the needle thread T is generated on the cloth C. However, the needle thread T is kept free without being sandwiched between the embroidery cloth presser and the cloth C. This prevents an embroidery sewing position from being displaced as a result of pulling of the cloth by the needle thread T and also precludes the cross-over thread of the needle thread T from failing to be drawn in and remaining on the embroidery surface. Therefore, the embroidery cloth presser 1 according to Embodiment 1 exerts a notable effect of allowing beautiful and accurate embroidery patters to be produced.

The embroidery cloth presser according to the present invention can be widely utilized as a cloth presser for an embroidery sewing machine or a sewing machine with an embroidery sewing function. In particular, the embroidery cloth presser according to the present invention can be suitably used for a sewing machine with an automatic height adjusting function that always lowers the cloth presser onto the upper surface of the cloth to be embroidered depending on the thickness of the cloth.

EXPLANATION OF REFERENCE NUMERALS

M Sewing machine
W Embroidery frame
C, Ca Cloth
T, Ta Needle thread
1, 1*a* Embroidery cloth presser
2, 2*a* Needle
3, 3*a* Presser bar
4, 4*a* Set screw
5, 5*a* Threaded hole
6 Attachment portion
7 Recessed portion
8*g*, 8*h* Fitting surface
9 Attachment surface
10 Screwing groove
11 Leg portion
12, 12*a* Presser portion
13, 13*a* Eye of needle
14, 14*a* Bottom surface
15, 15*a* Projection

What is claimed is:

1. An embroidery cloth presser installed on a presser bar of a sewing machine to press a cloth to be embroidered, the embroidery cloth presser comprising:

a plurality of projections provided on a bottom surface of the cloth presser which contact the cloth around a needle and forming, between the cloth presser and the cloth, a gap for allowing a needle thread to pass, a distance between edges of the projections being constant, wherein the projections are provided so as to surround the needle, and wherein the projections are spaced such that the needle thread passes through the gap and then through a space between the plurality of projections, and wherein the space between the plurality of projections is provided below the bottom surface of the cloth presser and at a distal end of the bottom surface such that the thread passes through the space.

2. The embroidery cloth presser according to claim 1, wherein the projections are arranged at predetermined intervals.

3. The embroidery cloth presser according to claim 1, wherein each of the projections has a semispherical surface shape at a tip thereof.

4. The embroidery cloth presser according to claim 1, wherein each of the projections has a round truncated cone shape or a truncated pyramid shape at a tip thereof.

5. The embroidery cloth presser according to claim 1, wherein a first projection of the plurality of projections is provided at a first position on a first side of the needle, and wherein a second projection of the plurality of projections is provided at a second position on the first side of the needle.

6. The embroidery cloth presser according to claim 5, wherein a third projection of the plurality of projections is provided at a third position on a second side of the needle, and wherein a fourth projection of the plurality of projections is provided at a fourth position on the second side of the needle.

7. The embroidery cloth presser according to claim 1, wherein the projections are arranged at intervals such that a first distance between a projection to a first adjacent projection is not equal to a second distance between the first adjacent projection to a second adjacent projection, the second adjacent projection being adjacent to the first adjacent projection, so as to entirely surround the needle.

8. The embroidery cloth presser according to claim 1, wherein the projections are arranged at regular intervals such that a distance between each projection to an adjacent projection is equal so as to entirely surround the needle.

9. The embroidery cloth presser according to claim 1, further comprising:

an attachment portion attached to the presser bar, the attachment portion including:

a recessed portion through which a lower end of the presser bar is fitted; and a screwing groove in which a set screw threaded into a threaded hole in the presser bar is fitted.

10. The embroidery cloth presser according to claim 9, wherein the recessed portion comprises a U-shaped cross-section in a planar view.

11. The embroidery cloth presser according to claim 9, wherein the recessed portion includes:

an attachment surface that comes into abutting contact with a side surface of the presser bar to form a stable fixed state when the set screw is tightened; and fitting surfaces extending laterally from the attachment surface to form an opening opposite the attachment surface, wherein at least one of the fitting surfaces is inclined such that the presser bar is laterally fitted through the recessed portion.

12. The embroidery cloth presser according to claim 11, wherein the screwing groove extends from a first fitting surface of the fitting surfaces to a position on the attachment surface corresponding to the threaded hole.

13. The embroidery cloth presser according to claim 1, wherein a height of the projections is set equal to or greater than a diameter of the needle thread.

14. An embroidery cloth presser installed on a presser bar of a sewing machine to press a cloth to be embroidered, the embroidery cloth presser comprising:

a plurality of projections provided on a bottom surface of the cloth presser which contacts the cloth around a needle and forming, between the cloth presser and the cloth, a gap through which a needle thread passes, a distance between edges of the projections being constant, wherein at least two projections of the plurality of projections are disposed on a same side of the needle, and wherein the projections are spaced such that the needle thread passes through the gap and then through a space between the plurality of projections, and wherein the space between the plurality of projections is provided below the bottom surface of the cloth presser and at a distal end of the bottom surface such that the thread passes through the space.

15. An embroidery cloth presser installed on a presser bar of a sewing machine to press a cloth to be embroidered, the embroidery cloth presser consisting of:

a single projection provided on a bottom surface of the cloth presser which contacts the cloth around a needle and forming, between the cloth presser and the cloth, a gap for allowing a needle thread to pass, wherein a height of the projection is set equal to or greater than a diameter of the needle thread, and wherein the projection is disposed such that the needle thread passes through the gap and then a space between a distal end of the projection and the bottom surface of the cloth presser such that the thread passes by a distal end of the bottom surface of the cloth presser, thereby not being sandwiched between the bottom surface and the cloth.

* * * * *